United States Patent [19]

Urani

[11] Patent Number: 4,511,876

[45] Date of Patent: Apr. 16, 1985

[54] ELECTRICAL FUSE WITH RESPONSE INDICATOR

[75] Inventor: Angelo Urani, St. Louis, Mo.

[73] Assignee: McGraw-Edison Company, Rolling Meadows, Ill.

[21] Appl. No.: 464,729

[22] Filed: Feb. 7, 1983

[51] Int. Cl.[3] ..... H01H 85/30

[52] U.S. Cl. ..... 337/244; 337/241

[58] Field of Search ..... 337/244, 241, 267, 265, 337/148, 239; 361/118; 116/217

[56] References Cited

U.S. PATENT DOCUMENTS 2,165,636 7/1939 Lemmon ..... 337/239

4,032,877 6/1977 McAlister ..... 337/148

*Primary Examiner*—Harold Broome

*Attorney, Agent, or Firm*—Charles W. MacKinnon; Jon Carl Gealow; James A. Gabala

[57] ABSTRACT

An elongated fuse housing includes a fusible wire longitudinally extended and coaxially mounted within a housing having end terminals. A spring indicator unit is secured to one end and includes a relatively large diameter loosely wound section forming a helical compression spring in combination with an integral, coaxial and tightly wound elongated indicator coil which extends axially of the spring. The spring/indicator unit is located within the housing with the coil spring held compressed by the fusible wire. The one end terminal includes an opening aligned with the wire-wound indicator coil. Disruption of the fusible wire releases the coil spring which expands within the housing to rapidly separate the fuse wire and simultaneously move the elongated wire-wound indicator coil through the opening, thereby indicating operation of the fuse.

11 Claims, 5 Drawing Figures

ELECTRICAL FUSE WITH RESPONSE INDICATOR

BACKGROUND OF THE PRESENT INVENTION

This invention relates to a fuse for connection in and protection of an electrical circuit.

Various fuse devices have been developed for connection into an electrical circuit to open the circuit in response to abnormal current conditions. The fuse elements may include a current conductor which will carry normal current. Preselected abnormal currents result in heating of the element to a fusing level which results in disruption of element and opening of the circuit. This of course is desirable to protect the electrical devices in the circuit. A visual indicator identifying a particular actuated fuse unit is, of course, also often desirable. Various indicating systems have also been suggested. For example, U.S. Pat. No. 2,165,636 which issued July 11, 1939 for an electric fuse, discloses an end-mounted spring element secured to the exterior end of an elongated fuse and interconnected to a fusible element. Abnormal current disrupts and opens the fuse element, releasing the spring structure which then falls from the fuse to provide an indication of the fuse response. An external coil spring includes one end connected to the fuse element by two or three turns of the spring thereon and the opposite end provided with an integral guide for guiding of the fuse element back through the opening into and through the housing. The fuse wire extends from the spring member and is affixed to the terminal external to the housing and spring structure. When the fuse burns open, the spring expands and also drops down such that the hanging unit provides a visual indication of the fuse disruption. Another elongated fuse structure having a special indicator is shown in a more recently issued U.S. Pat. No. 4,023,877 which issued June 28, 1977 and is assigned to the same assignee as the present application. The fuse structure shown therein is a cartridge type adapted to be inserted in a fuse clip assembly. The fuse structure includes an elongated housing having cup-shaped end terminals. A fuse unit within the housing is connected between the end terminals, and in particular includes a relatively heavy rod-like non-fusible element. The one end of the non-fusible element is secured to the one end contact by a fusible material. The rod extends through the housing and terminates in spaced relation to the second contact. A coil spring encircles the rod and acts between a central abutment and the end of the rod. Abnormal current flow disrupts the fusible material and releases the connection to the rod. This releases the spring which expands and carries the indicator rod outwardly, with the total expansion being selected to move the head outwardly of the housing. Thus, both ends of the housing define an indicator of the fuse response. Thus, the one end provides a distinct opening while the opposite end had the solid rod projecting outwardly.

Although various prior art devices have been suggested, there is a need for a relatively reliable but inexpensive fuse indicator structure for elongated tubular fuse elements.

SUMMARY OF THE PRESENT INVENTION

The present invention is particularly directed to an elongated fuse device having an outer tubular housing within which a coil spring having an integral tightly wound indicator coil is mounted, and wherein the coil spring is coupled to an elongated fuse element which holds the indicator within the housing. Opening of the fuse element releases the coil spring which moves the integral indicator coil through an aperture in one end of the fuse device. More particularly, in accordance with the present invention, the fuse includes a tubular housing with a fuse element coaxially extended therethrough and connected at the opposite ends to end fuse contacts or terminals. The housing has a diameter substantially larger than the fuse element. The coil spring with the integral indicator coil includes a helical compression coil spring of an outer diameter less than that of the inner diameter of the housing and greater than that of the fuse element in combination with a small diameter and tightly wound indicator coil which is wound directly about and connected to one end portion of the fuse element. The compression spring coil is located within the one end of the housing and normally is compressed against an internal stop by the fuse element, to hold one end of the coil spaced from the apertured end contact and the indicator coil within the housing. The indicator coil is wound onto the fuse wire for substantially the complete length of the indicator coil. A connecting wire which connects the fuse wire to the fuse contact or terminal is of sufficient length to permit the movement of the coil indicator from the housing.

The single integrated structure of the operational spring coil and coiled indicator provides a simple and inexpensive but reliable cartridge fuse structure with a fuse response indicator.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF THE ILLUSTRATED EMBODIMENT

Figure 1:
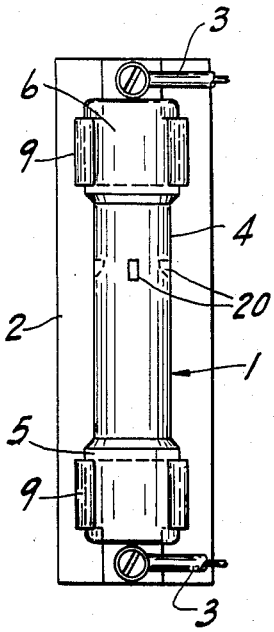
FIG. 1 is an elevational view of a cartridge fuse unit for purposes of illustrating an embodiment of the present invention.
Figure 4:
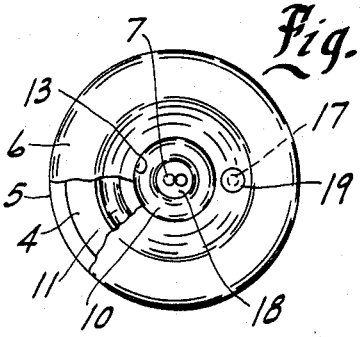
FIG. 4 is an end view of the fuse device.
Figure 2:
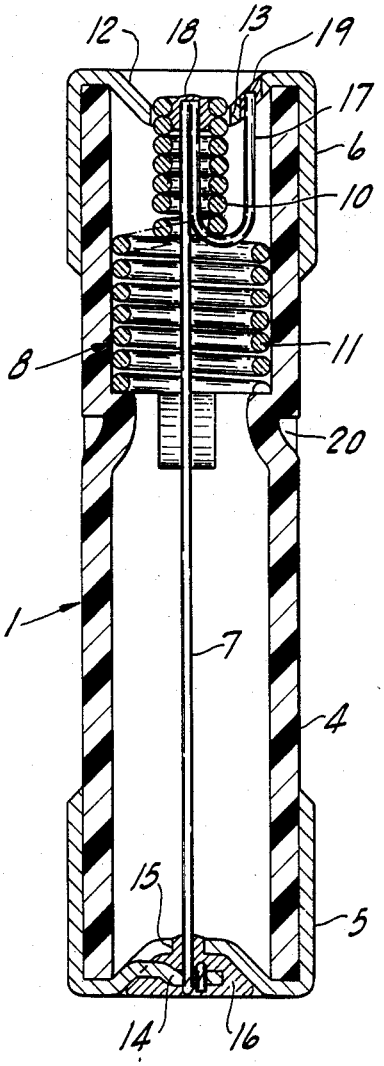
FIG. 2 is an enlarged vertical longitudinal section through the fuse unit shown in FIG. 1.
Figure 3:
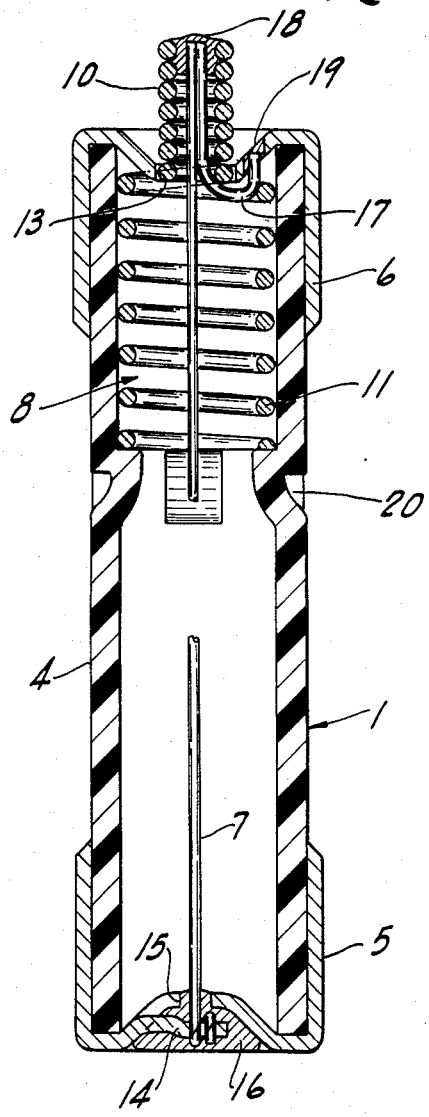
FIG. 3 is another sectional view of the fuse device shown in FIG. 2 illustrating the fused position of the fuse unit and in particular the helical coil indicator.

Referring to the drawing and particularly to FIG. 1, an elongated cartridge fuse device 1 is shown mounted in a fuse holder 2 for connection in series into an electrical circuit having conductors 3 connected to the fuse holder 2. The illustrated fuse device is a conventional cartridge type including a tubular elongated housing or casing 4 closed at its opposite ends by cylindrical cap contacts or terminals 5 and 6. As best seen in FIGS. 2 and 3, fuse wire 7 within housing 4 electrically connects the cap terminals 5 and 6, and holds a combined spring-/indicator unit 8 in a stressed condition. The fuse holder 2 includes U-shaped contact clips 9 spaced in accordance with the spacing of the fuse terminals 5 and 6. The fuse unit 1 is inserted into the fuse clips 9, and the fuse wire 7 is thereby connected in series with the circuit conductors 3. Preselected abnormal current flow through the circuit results in internal heating of the fuse wire 7, which disrupts and opens. This opens the circuit, thereby protecting other circuit components from the abnormal current conditions. The present invention is particularly directed to the construction of the fuse unit 1 and particularly the incorporation therein of the spring/indicator unit 8 which serves to rapidly open the circuit and move an indicator coil 10 from within the housing 4, as shown in FIG. 3. The illustrated spring/indicator unit 8 includes a compression spring coil 11 as an integral and loosely wound extension of the indicator coil 10. The spring coil 11 is held compressed within the housing by the normal connection of the fuse wire 7, as shown in FIG. 2. Upon the burning open of the fuse wire, the spring coil 11 is released and expands within housing 4. The expansion of spring coil 11 rapidly opens wire 7 and simultaneously moves the indicator coil 10 from the fuse housing 4 to an exposed position.

End terminal 6 has an opening 13 in the end closing portion or wall 12 located on the center axis of the fuse housing 4 in alignment with the indicator coil 10. The diameter of opening 13 is slightly larger than that of the indicator coil 10. As any given circuit system may have a plurality of different fuses, it is desirable that the fuse unit provide an indication of its condition, such that problems can be located for quick circuit repair and easy fuse replacement.

Because the present invention is particularly directed to the structure of the spring/indicator unit 8 and its interconnection to the fuse element, no further description of the particular fuse holder is given other than as necessary to a full and complete understanding of the present invention.

As shown in FIG. 2, the fusible element 7 is any well known or suitable fuse wire or ribbon of a cross-sectional area capable of carrying normal circuit currents. The fusible wire 7 extends throughout housing 4 and is secured at the opposite ends thereof to end terminal 5 and indicator coil 10.

Terminals 5 and 6 are cup-shaped members or caps having a tubular portion which projects over tubular housing 4. The ends of terminals 5 and 6 are dished inwardly as shown in FIG. 2. Terminal 5 has a hook-shaped finger 14 overlying an end opening 15.

One end of wire 7 projects through end opening 15 and is connected directly to terminal 5 as by mechanically wrapping it about finger 14 to secure it and/or embedding it within a soldered connection 16. The opposite end of the wire 7 is connected to the indicator coil 10 and to the end terminal 6 by a connecting shunt lead 17.

In the illustrated embodiment of the invention, the spring/indicator unit 8 is a single wire element formed of a suitable spring metal, such as a stainless steel.

Spring/indicator unit 8 includes the spring coil 11 wound with spaced turns of an outer diameter essentially corresponding to the inner diameter of the fuse housing 4. The spring coil 11 has a length substantially less than the length of the housing 4 and functions as a conventional helical compression spring.

The indicator coil 10 is wound as an integral extension of the spring coil 11. The indicator coil 10 is wound as a tightly wound coil member with the coil turns in immediate touching relationship to form a non-compressive, rod-like member.

The length of the indicator coil 10 is preferably at least equal to the length of the expanded compression spring coil. The wire 7 extends through the indicator coil 10 and is mechanically affixed thereto by a soldered connection 18. The shunt lead 17 is also secured in place and connected to the adjacent end of fuse wire 7 by the soldered connection 18. The shunt wire extends backwardly through the core of indicator coil 10 and then back along the exterior of the spring/indicator unit 8 to a soldered connection 19 to end termial 6. The shunt wire 17 insures a good electrical circuit connection between the end terminals 5 and 6 by the fusible element.

The fuse housing 4 includes internal stop wall means 20 intermediate the length of the housing 4. Although the stop wall means 20 can be formed in any suitable manner, it is conveniently formed by a plurality of inwardly struck portions of the insulating housing 4 which are equicircumferentially spaced about the housing. In the illustrated embodiment of the invention, four equicircumferentially inwardly struck portions are illustrated. The stop wall means 20 is spaced from the end wall of terminal 6 by a distance approximately equal to the total length of the compressed spring coil 11 and indicator coil 10. Although such distance is not critical, it is preferably constructed such that the indicator coil 10 is essentially enclosed within housing 4 in the normal current conducting state of fusible wire 7.

In assembly, the fuse spring/indicator unit 8 is mounted in the fuse housing 4 with the fuse shunt lead 17 connected to terminal 6 and extending through indicator coil 10.

Fuse wire 7 projects back through fuse housing 4 with its opposite end connected to the terminal 5. This holds the coil spring 11 compressed against stop wall means 20, and with the spring coil 11 and the indicator coil 10 retracted within the housing, as shown in FIG. 2.

The normal fuse unit 1 is placed into the fuse holder 2 and provides the circuit connection between the circuit conductors 3.

A normal good fuse is indicated by the retraction of the indicator within the fuse housing. Fuse wire 7 holds indicator 10 retracted with the spring coil 11 compressed. Abnormal current results in opening of fuse wire 7, with a release of the mechanical holding of spring coil 11. As spring coil 11 expands within housing 4 between stop wall means 20 and end terminal 6, it forces indicator coil 10 outwardly through aligned opening 13, as shown in FIG. 3. Thus, the blown or open state of the fuse 1 is clearly indicated.

Figure 5:
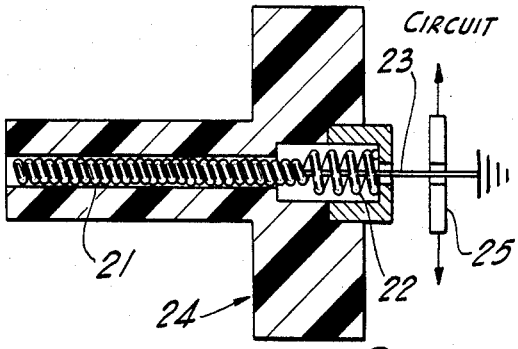
FIG. 5 is a diagrammatic illustration of a fuse unit showing another embodiment of the invention.

A second embodiment of the invention is shown in FIG. 5. In this embodiment an indicator coil 21 is again intergrally wound as an extension of a spring coil 22 to define a coil spring/indicator unit. The coil 21 includes tightly wound, abutting coil turns but is substantially longer and is wound directly on a tension or strain wire 23, which may also be soldered to the coil to form an improved mechanical connection. The coil spring/indicator is mounted in a tubular, stepped support 24 with tension wire 23 projecting through the spring coil portion 22 and through a high voltage gap member 25 which is connected in a circuit. Creation of a high voltage condition in the circuit would cause the spark-over to strain wire 23. The arc voltage would burn open strain wire 23 thereby releasing the spring-loaded coil/-spring indicator 21.

Support 24 is a solid member having an enlarged inhead portion and an extended barrel portion of a reduced diameter. Strain wire 23 again holds spring coil portion 22 in a compressed condition and indicator coil 21 is thereby retracted into the barrel portion of support 24. When strain wire 23 is broken the coil spring/indicator unit of the second embodiment again functions to indicate an abnormal voltage by allowing the indicator coil 21 to extend out of support 24.

Various modifications and rearrangements of the components can, of course, be effective. The indicator coil may even extend in a reverse direction within the spring coil, and the coil spring constructed to function as a tension spring which collapses and moves the indicator outwardly through the end terminal.

The single integrated spring unit consisting of the coil spring in combination with the smaller diameter tightly wound indicator coil provides a simple but effective spring and indicator for incorporation into a fuse unit.

Various modes of carrying out the invention are contemplated as being within the scope of the following claims, particularly pointing out and distinctly claiming the subject matter which is regarded as the invention.

I claim:

1. An elongated fuse device having a tubular insulating housing having first and second end terminals, a fuse element connected to the first end terminal and extending longitudinally through the housing, a spring/indicator unit including a spring coil and an integrated close wound indicator coil of a substantially smaller diameter located within the housing adjacent said second end terminal, said indicator coil being wound as an extension from one end of said spring coil, said spring coil having a diameter substantially larger than said fusible element with said fusible element extending therethrough, said fusible element extending through and connected to said indicator coil, means electrically connecting said fuse element to said second end terminal and constructed and arranged to permit movement of said spring/indicator unit upon opening of said fusible element, said housing including an internal stop wall means, said spring being located between said stop wall means and said second terminal whereby said fuse element holds the spring in a stressed state with said indicator withdrawn into said housing, fusing of said element releasing said spring coil to release its stress and thereby move said indicator coil at least partially from within said housing to provide an indication of a blown fuse.

2. The fuse device of claim 1 wherein said indicator coil is at least as long as said spring coil under stress.

3. The fuse device of claim 1 wherein said spring coil is a helical compression spring.

4. A cartridge type fuse comprising an elongated cylindrical insulating housing, cylindrical cup-shaped end terminals secured to the opposite end of said housing, a fusible wire-like element within said housing and interconnected to said opposite end terminals, a spring/indicator unit located within said housing and including a helical compression coil spring having an outer diameter substantially corresponding to the inner diameter of said housing for free expansion and contraction within said housing, an indicator coil integrally formed as an outward extension of said coil spring and tightly wound on a common axis with said coil spring, said fuse wire-like element extending through said indicator coil and being affixed thereto, a jumper wire secured to said wire-like element and extending through and outwardly of said indicator coil and extending backwardly along the exterior of said indicator coil and being of sufficient length to permit said indicator coil to move at least partially from within said housing, said jumper wire being connected to one of said terminals adjacent said spring/indicator unit, a stop wall means generally centrally located along said housing whereby said fusible element holds said helical coil spring compressed against said stop wall means within the housing with said indicator coil retracted substantially completely into said housing, said terminal adjacent said spring/indicator unit having an end face with an opening located on the center axis of said housing and aligned with said indicator coil, whereby fusing of said fusible wire-like element releases the compression spring and at least a portion of said indicator coil passes outwardly through said opening.

5. The cartridge type fuse of claim 4 wherein said wire-like element and said jumper wire are affixed to the outermost end of said indicator coil, and said jumper wire extends between the indicator coil and the adjacent end of the coil spring.

6. An electric fuse comprising a tubular housing, a first terminal secured to a first end of said housing and having an opening in an end wall, a second terminal secured to a second end of said housing, internal stops extending inwardly from the interior wall of said housing, a spring/indicator unit including a helical compression spring of an outside diameter substantially corresponding to that of the inside of said housing and a tightly wound indicator coil as an integral extension of said compression spring, said indicator coil having a diameter substantially less than said compression spring and defining a substantially semi-rigid rod-like member, said spring/indicator unit being disposed between said first terminal and said stops during normal use, with said helical compression spring abutting said stops and said indicator coil aligned with said opening, a fusible element having a first end connected to said second terminal and a second end secured to said indicator coil and holding said compression spring compressed abutting said stops and holding said indicator coil within said housing in alignment with said opening, a shunt wire connected to said indicator coil and extending from the inner end of said coil to said first terminal, whereby fusing of said fusible element releases said compression spring which expands to move at least a portion of said indicator coil outwardly through said opening with one end of said shunt wire moving with said indicator coil.

7. The electric fuse of claim 6 wherein said spring/indicator unit is formed of a single wire element wherein the turns of said indicator coil are in abutting engagement and are of a length approximately equal to the length of the expanded compression spring.

8. A fuse device having a tubular insulating housing with at least a first end terminal, a fusible element electrically connected at a first end to said first end terminal and extending longitudinally through the housing, a spring/indicator unit including a spring coil and an integrated close wound indicator coil of a substantially smaller diameter than said spring coil located within said housing adjacent said first end terminal, said indicator coil being wound as an extension from one end of said spring coil, said spring coil having a diameter substantially larger than said fusible element with said fusible element extending therethrough, said fusible element extending through and connected to said indicator coil, said housing including an internal stop wall means, said spring coil being located between said stop wall means and said first end terminal whereby said fuse element holds said spring coil in a stressed state with said indicator coil withdrawn into said housing, the fusing of said fusible element releasing said spring coil to release its stress and thereby move at least a portion of said indicator coil from within said housing to provide an indication of a blown fuse.

9. The fuse device of claim 8 wherein said first end terminal includes an opening smaller than said spring coil and larger than said indicator coil, said opening being aligned with said indicator coil, and said spring coil being a helical compression spring.

10. The fuse device of claim 8 wherein said fuse device has a second end terminal having an inwardly dished end wall and having a struck-out attachment finger within the dished portion of said end wall, said fusible element having a second end wrapped about said finger to provide a mechanical support, and a conductive solder substantially filled said dished portion to mechanically and electrically connect said fusible element to said second end terminal.

11. A fuse indicator device comprising a housing having an end closure with an opening, a coil spring/indicator unit located within said housing and including a spring coil and an integrated close wound indicator coil of a substantially smaller diameter than said spring coil, said spring coil located within said housing adjacent said end closure and aligned with said opening, a fusible tension wire, said indicator coil being wound as an extension from one end of said spring coil and being wound tightly upon said fusible tension wire, said housing including internal stop wall means, said spring coil being located between said internal stop wall means and said end closure whereby said wire holds said spring coil compressed with said indicator coil retracted into said housing, and the fusing of said fusible tension wire releasing said spring coil to thereby release its stress and move at least a portion of said indicator coil from within said housing.

* * * * *

UNITED STATES PATENT AND TRADEMARK OFFICE

CERTIFICATE OF CORRECTION

PATENT NO. : 4,511,876

DATED : April 16, 1985

INVENTOR(S) : Angelo Urani

It is certified that error appears in the above-identified patent and that said Letters Patent is hereby corrected as shown below:

In Claim 10, line 7, delete "filled" and substitute -- filling --.

Signed and Sealed this

*Twenty-third* Day of *July 1985*

[SEAL]

*Attest:*

DONALD J. QUIGG

*Attesting Officer*

*Acting Commissioner of Patents and Trademarks*